United States Patent [19]

Metzger

[11] 4,084,704

[45] Apr. 18, 1978

[54] CAR COUPLER

[75] Inventor: William J. Metzger, Willowick, Ohio

[73] Assignee: Midland-Ross Corporation, Cleveland, Ohio

[21] Appl. No.: 733,434

[22] Filed: Oct. 18, 1976

[51] Int. Cl.[2] ..... B61G 3/00

[52] U.S. Cl. ..... 213/100 W; 213/154

[58] Field of Search ..... 213/100 W, 153, 154

[56] References Cited

U.S. PATENT DOCUMENTS

| | | | |
|---|---|---|---|
| 681,646 | 8/1901 | Potts | 213/153 |
| 2,825,473 | 3/1958 | Metzger | 213/153 |

FOREIGN PATENT DOCUMENTS

| | | | |
|---|---|---|---|
| 921,297 | 3/1963 | United Kingdom | 213/100 W |

*Primary Examiner*—Trygve M. Blix
*Assistant Examiner*—D. W. Keen
*Attorney, Agent, or Firm*—Henry Kozak

[57] ABSTRACT

In a car coupler of the rigid-jawed type, aligning means is provided for substantially increasing the gathering range of the coupler in both lateral and angular directions during coupling operations. In addition, the coupler is provided with anti-telescoping protection in a vertical direction between two coupled couplers.

8 Claims, 12 Drawing Figures

CAR COUPLER

BACKGROUND OF THE INVENTION

The invention relates to car couplers of the rigid-jawed type such as are used in mine, industrial and railway service. Particularly in mine service the couplers may approach for coupling from substantially laterally displaced or angled positions relative to one another as to make coupling difficult or impossible. In such cases, when the couplers are so disposed as to be beyond their gathering range, the couplers may need to be manually aligned in order to assure positive coupling. Manual alignment of couplers involves the risk of injury to the trainman and is to be avoided wherever possible. Also, coupled couplers of this type usually have no means for preventing separation thereof in a vertical direction, as may tend to occur during a derailment. The invention in addition to increasing the coupler gathering range also provides positive means for precluding vertical separation of coupled couplers.

SUMMARY OF THE INVENTION

The invention is directed to the provision in a rigid-jawed coupler, otherwise well known as the Willison coupler, of aligning means for increasing both the lateral and vertical gathering range of the coupler. The invention further provides means which allows a limited amount of relative vertical movement between coupled couplers but positively prevents disengagement thereof in a vertical direction. The invention has been applied to a coupler similar to that shown in W. J. Metzger U.S. Pat. No. 2,792,946. The coupler as shown in that patent, in addition to having the usual buffing and pulling jaws, has a laterally extending aligning wing disposed rearwardly of the buffing jaw. The lateral aligning wing increases the gathering range of the coupler but under an extreme angled condition of the couplers may fail to align couplers approaching for coupling because the end of the pulling jaw of an opposing coupler may slide off the end of the aligning wing and result in a miscoupling. To avoid such miscoupling, the end of the aligning wing has been provided with a forwardly extending projection which prevents the end of the opposing coupler pulling jaw from sliding off the end of the aligning wing. In this manner the couplers will swing into position from which successful coupling can be effected. Also, the buffing jaw is extended upwardly and is provided at its upper end with a ledge portion which is adapted to overlie the head of an opposing coupler and prevent vertical "slip by" of the couplers. In addition, the upward extension and the ledge portion have faces which are continuous with and lie in the same plane as the front buffing face of the buffing jaw. The outermost edge of the front face on the ledge portion is adapted to engage the buffing face of an opposing coupler as the couplers approach for coupling and thereby increase the lateral gathering range of the coupler.

It is, accordingly, an object of the invention to provide means in a rigid-jawed coupler for increasing the gathering range of the coupler whereby the successful coupling of couplers may be effected from laterally displaced positions and angular positions of greater extent than were previously possible. Another object is to provide on such a coupler, novel means for limiting relative vertical movement between coupled couplers.

The foregoing and other features of the invention will be apparent from the following detailed description taken in conjunction with the accompanying drawings.

DESCRIPTION OF THE PREFERRED EMBODIMENT

Figure 8:
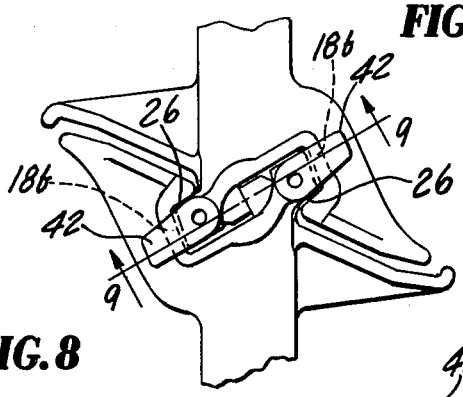
FIG. 8 is a plan view of coupled couplers embodying the invention.

Referring to the drawings, there is shown a coupler having a head 10 and a shank 12 having a verticle opening 14 for receiving a pivot pin for pivotal mounting of the coupler. The coupler head comprises a buffing jaw 16 and a pulling jaw 18 spaced apart transversely on opposite sides of the longitudinal centerline of the coupler. Buffing and pulling jaws 16 and 18 have diagonal front buffing faces 16*a* and 18*a*, respectively, for gathering and aligning an opposing similar coupler during coupling operations. Connecting the buffing and pulling jaws is the buffing face 20 on the head, which is disposed in a vertical plane that is approximately parallel to the plane of face 16*a*. Buffing face 20 is engaged by face 16*a* of the jaw of an opposing coupler whenever coupled couplers are subjected to buffing forces. Pulling jaw 18 has a recess 22 adopted for receiving the complementary buffing jaw of an opposing coupler, as seen in FIG. 8. Forming one side of recess 22 on pulling jaw 18 is pulling face 24 adapted for engagement with complementary face 26 on the buffing jaw of an opposing coupled coupler when the couplers are subjected to pulling forces.

Figure 1:
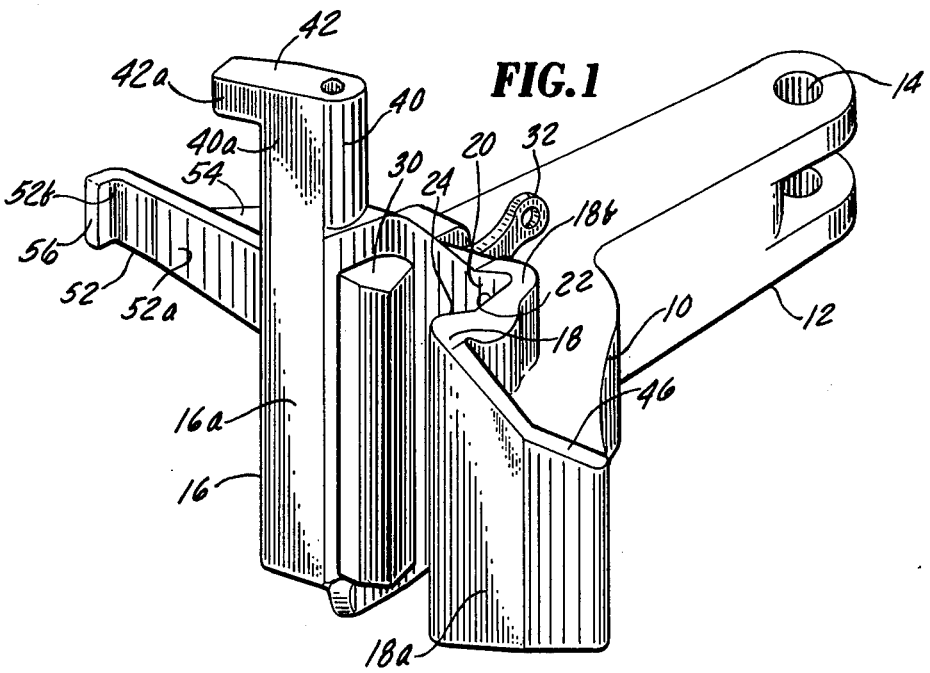
FIG. 1 is a perspective view of a coupler embodying the invention.

A movable lock 30 is provided in head 10 for maintaining the coupler in coupled relation with a mating coupler. Lock 30 is disposed adjacent jaw 16 and in its locking position projects forwardly of buffing face 20. Lock 30 is adapted to move rearwardly into the coupler head to permit passage of jaw 16 of the opposing coupler during a coupling operation. A spring (not shown)

within the coupler head urges lock 30 to its forward locking position as seen in FIGS. 1 and 8. The lock may be retracted against the force of the spring by the actuation of a pivoted lever 32 mounted on the coupler head.

The improved coupler has an upward extension 40 on the head forming a continuation of buffing jaw 16. Extension 40 at its upper end has a ledge portion 42 which extends diagonally forwardly of the coupler and is adapted to overlie portion **18*b* on pulling jaw 18 of an opposing coupler when the couplers are in coupled relation. It will be noted that ledge portion 42 overhangs side face 41 of buffing jaw 16, side face 41 extending rearwardly from the forward edge of buffing face 16*a*. The forward face 40*a* on extension 40 is a continuation of and lies in the same vertical plane as buffing face 16*a*. Also, the forward face 42*a* of ledge portion 42 lies in the same plane as buffing face 16*a***.

Figure 2:
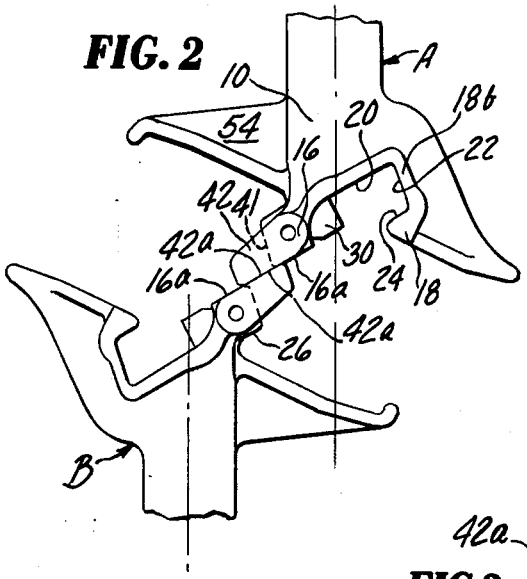
FIG. 2 is a plan view of couplers embodying the invention approaching for coupling from laterally displaced positions.

Referring to FIG. 2, the couplers as they approach for coupling are shown displaced laterally to the left side of one another and both couplers are disposed at the same elevation. It will be observed that faces **42*a* of extensions 40 are in engagement and as the couplers move toward one another the gathering action of faces 42*a* will cause the couplers to move laterally toward longitudinal alignment. As movement of the couplers progresses the buffing faces 16*a* will come into engagement after which relative sliding of those faces against one another will move jaws 16 into recesses 22 wherein the couplers are in coupled relation as seen in FIG. 8**.

Figure 3A:
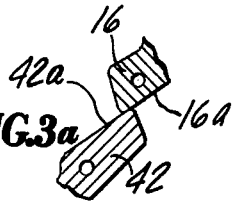
FIG. 3*a* is a horizontal sectional view along line 3*a*—3*a* of FIG. 3.
Figure 3:
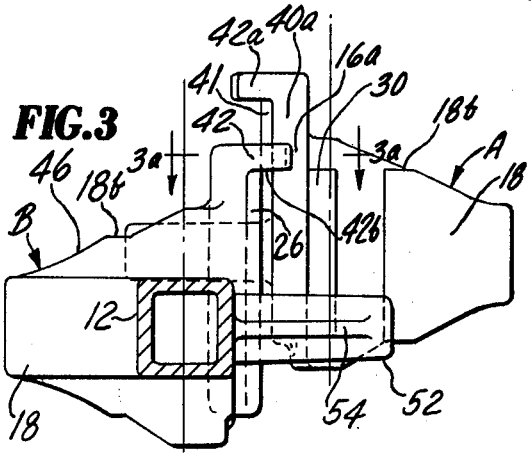
FIG. 3 is a front elevational view of the couplers shown in FIG. 2, the couplers being displaced vertically as well as laterally.

In the event the couplers of FIG. 2 are also displaced apart vertically as seen in FIG. 3, face **42*a* of coupler B may engage buffing face 16*a* of coupler A. As the couplers are moved toward each other, face 42*a* on coupler B will slide along face 16*a* of coupler A until face 16*a* of coupler B is in contact with face 16*a* of coupler A. Thereafter face 16*a* will guide the couplers into coupled relationship. It will be appreciated that the couplers cannot be vertically displaced such an amount as would preclude the horizontal underside 42*b* of ledge 42 from passing over the top portion 18*b* of jaw 18** as the couplers move to final coupled relationship.

It will be evident from FIGS. 2 and 3 that without faces **42*a*, the couplers could not have been successfully coupled from the positions shown. Instead, buffing jaws 16 would have passed to the left of each other, resulting in a miscoupling. Thus, the invention increases substantially the lateral gathering range of the coupler. Moreover, the extent of the lateral gathering may be varied by either increasing or decreasing the length of ledge 42** as desired.

Figure 4:
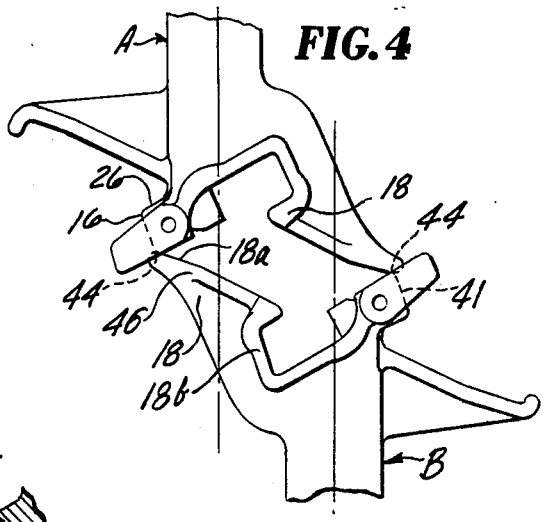
FIG. 4 is a plan view of the couplers of FIG. 2, but with the couplers laterally displaced on the opposite side from that in FIG. 2

Referring to FIG. 4, the couplers are shown displaced laterally to the right side of one another, and both are at the same elevation. Engagement between the couplers occurs at the end of jaw 18 at surface **18*a* thereof and the forward edge 44 of buffing jaw 16. As the couplers are moved toward each other from this position, the edge 44 of each coupler slides along the opposing surface 18*a*, thereby causing the couplers to move into longitudinal alignment and into coupled relationship. In the FIG. 4 position of the couplers, ledge 42 does not affect the gathering of the couplers in a horizontal direction as they approach for coupling. The extent of gathering may be increased by increasing the lateral extent of length of jaw 18** as desired.

Figure 5:
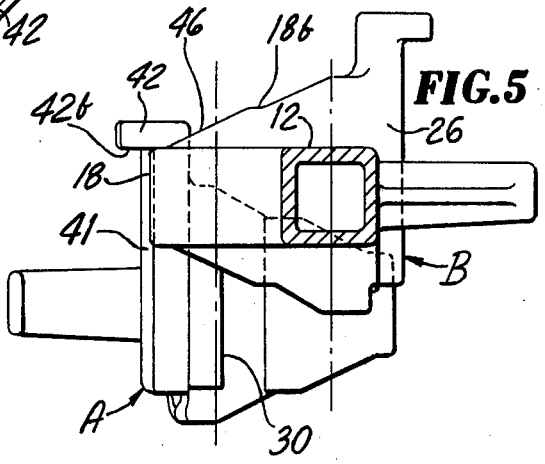
FIG. 5 is a front elevational view of the couplers of FIG. 4, the couplers being displaced vertically as well as laterally.

In FIG. 5 the couplers, in addition to being displaced laterally the same amount as in FIG. 4, are also displaced apart vertically. The couplers as they move toward each other for coupling will gather laterally in the same manner as those in FIG. 4, the edge 44 of each buffing jaw sliding along the opposing face **18*a* until jaws 16 are in coupled relation with jaws 18, as in FIG. 8. Simultaneous with the lateral gathering, the upwardly sloping top surface 46 of jaw 18 of coupler B engages the underside of ledge 42. Thus, as the couplers approach, the low coupler A will be raised by the camming action of surface 46 against underside of ledge 42 until the couplers have been coupled. When the couplers are coupled, the difference in elevation between the couplers will have decreased so as to be about the same as shown in FIG. 3. Referring to FIG. 5, when the couplers have been coupled, the underside of ledge 42 of coupler A will rest on top portion 18*b* of jaw 18** on coupler B.

Figure 6:
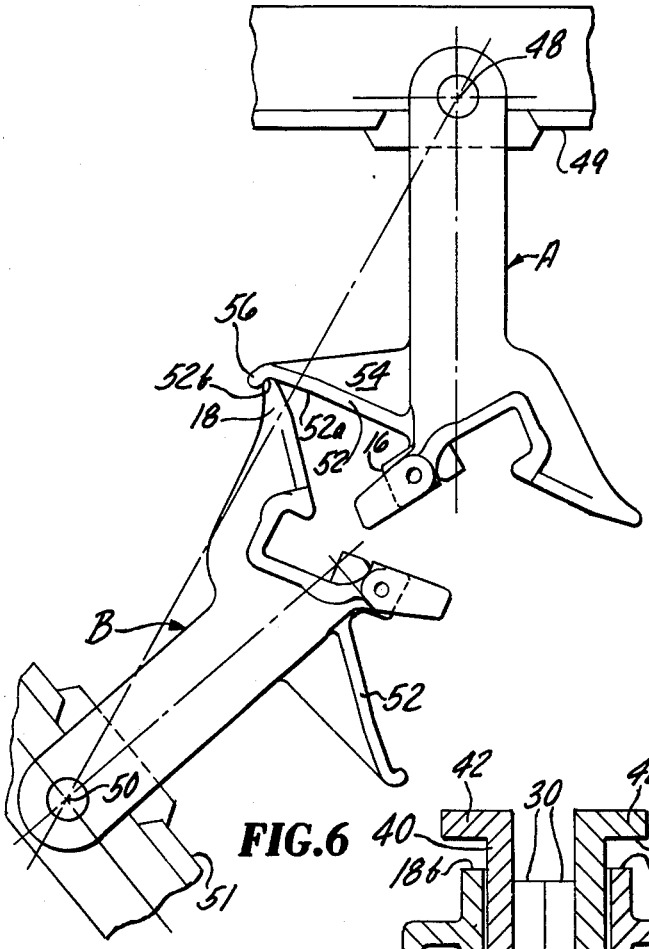
FIG. 6 is a plan view of couplers embodying the invention approaching for coupling from an angular position as with cars on a curved track.

In FIG. 6 the couplers are shown in a position of quite extreme angularity as they approach for coupling. Coupler A is pivotally connected as at 48 to rail vehicle 49, while coupler B is pivotally connected as at 50 to vehicle 51, both vehicles being shown in position corresponding to that occupied on a curved track. This view shows the alinging action of wing 52 when the couplers are to be coupled while in relative angular positions. Aligning wing 52 extends laterally from the coupler head and is disposed rearward of buffing jaw 16. Wing 52 is reinforced by a web 54 and in accordance with the invention is formed at its lateral extremity with a forwardly extending projection 56 disposed about right angles to the forward face **52*a*, thereby providing a shoulder or socket 52*b*. The forward end of pulling jaw 18 of coupler B is shown engaged in socket 52*b* of coupler A. As the couplers are moved toward each from the position shown, they will pivot about the engaged socket 52*b* and thus swing into alignment for coupling. It will be noted that the point of engagement between jaw 16 and socket 54*a* lies to the left side of a line joining the coupler pivot connections 48 and 50**, so that the force exerted by the jaw against the socket will cause coupler A to rotate clockwise and coupler B to rotate counterclockwise. In this manner, the couplers will be swung about their pivots into proper alignment for accomplishing successful coupling.

Figure 7:
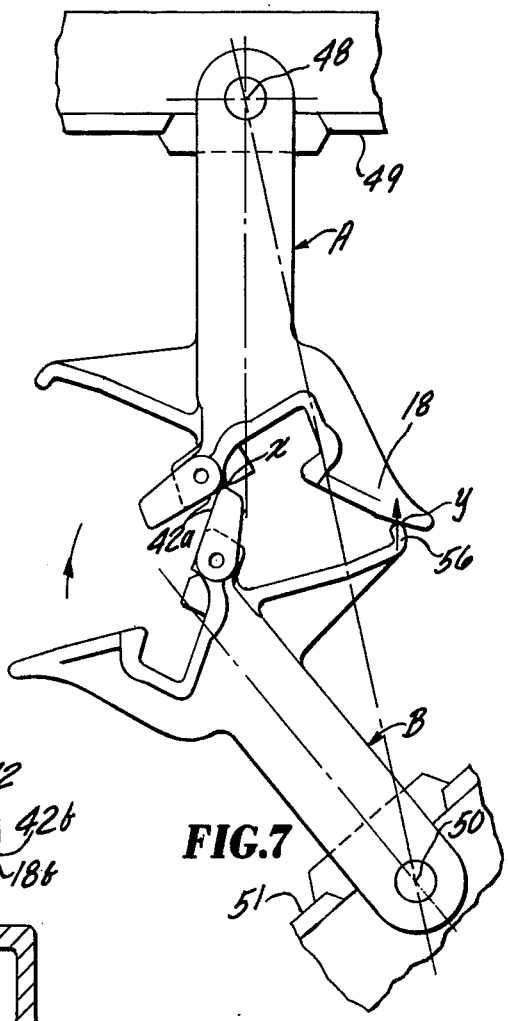
FIG. 7 is a plan view of the couplers of FIG. 6 approaching for coupling from an angled position opposite to that shown in FIG. 6.

Referring to FIG. 7, the couplers A and B are in angled relationship corresponding to that which occurs when the vehicles to which they are connected are located on a curve disposed opposite to that of FIG. 6. In this view, the couplers are in contact as at "*x*" between the forward edge of buffing face **42*a* on coupler B and the inner edge of face 42*a*** on coupler A. Also, contact exists at "*y*" between pulling jaw 18 of coupler A and projection 56 on coupler B. It will be appreciated that the engagement at "*x*" will cause surface **42*a* on coupler B to slide along the inner edge of face 42*a*** on coupler A to align the couplers as they move toward one anoher. This action is assisted by the engagement at "*y*" which causes coupler A to pivot counterclockwise and coupler B clockwise to bring the couplers into alignment for coupling.

Figure 9:
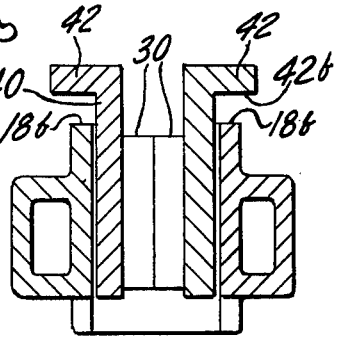
FIG. 9 is a vertical sectional view taken along line 9—9 of FIG. 8.

In FIG. 8, two couplers embodying the invention are shown in coupled relationship. It will be seen that ledge 42 of each coupler overlies portion **18*b* of the opposing coupler. The spacing of ledge 42 above portion 18*b* allow limited relative vertical displacement between coupled couplers but engagement between those elements serves to limit such movement and prevent vertical separation of the couplers, as may tend to occur during a derailment. The vertical interlock provided by ledge 42 is also illustrated in FIG. 9 from which it is apparent that the degree of spacing of the ledge above the coupler head determines the extent of relative vertical displacement that is permitted between the couplers before one of the ledges will engage the opposing portion 18***b* to preclude further displacement.

Figure 10:
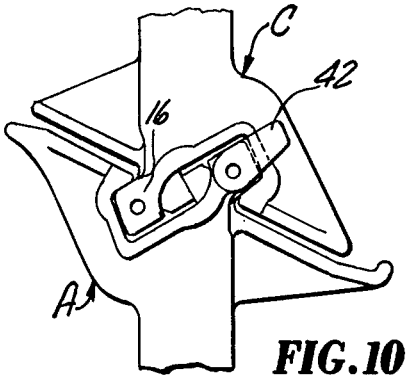
FIG. 10 is a plan view of a coupler embodying the invention in coupled relation with a coupler not embodying the invention.

In FIG. 10 coupler A, which embodies the invention, is shown in coupled relation with coupler C which does not embody the invention. The coupled relationship between the buffing and pulling jaws of the couplers is the same as exists with the couplers shown in FIG. 8. However, it will be seen that while ledge 42 on coupler A is effective to restrict downward movement of coupler A relative to coupler C, the latter coupler is free to move downwards without restriction relative to coupler A.

Figure 11:
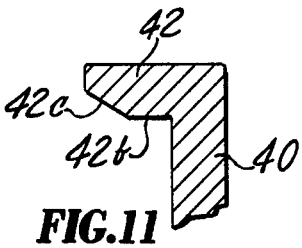
FIG. 11 is a view of a modified form of the ledge portion of the coupler.

In FIG. 11 a portion of the underside of ledge 42 is sloped upwardly, as at 42*c*, toward the end of the ledge instead of being horizontal as in the previous views. Surface 42*c* commences at a point about midway from side face 41 and the end of the ledge and serves to increase the vertical gathering of the couplers, as when, for example, they may be disposed apart vertically a greater amount than shown in FIG. 3 prior to a coupling operation. As the couplers come together for coupling, so long as the leading edge of surface 42*c* is at a slightly higher elevation than surface 18*b* on the opposing coupler, ledge 42 will readily slide over portion 18*b* on the opposing coupler to permit the couplers to attain final coupled position.

The invention provides a rigid jawed-type coupler having increased lateral as well as angular gathering range compared to existing couplers of that type. It permits successful coupling with a similar coupler from a position of lateral displacement relative to the coupler that is greater than the maximum laterally displaced position from which existing couplers could be coupled. Likewise, the improved couplers may be successfully coupled from an angled position that is greater than the maximum angled position from which existing couplers could be coupled. A feature of the invention resides in the fact that it serves to interlock coupled couplers against vertical separation.

What is claimed is:

1. A car coupler of the rigid jawed-type having a head comprising a buffing jaw and a pulling jaw, said jaws being spaced apart transversely of said head and disposed on opposite sides of the longitudinal centerline of the coupler, said jaws being adapted to interengage with the jaws of an opposing similar coupler, said buffing jaw having a diagonal buffing face on its forward side and a side face extending rearwardly from the forward edge of said buffing face, and coupler gathering means on said head, said means comprising ledge means spaced above the top of said head and extending diagonally forwardly of the coupler, said ledge means overhanging said side face and having a forward face disposed in the same plane as said buffing face, said forward face being adapted for engagement with said buffing face on an opposing similar coupler to cause laterally displaced couplers to move laterally toward longitudinal alignment as the couplers come together for coupling.

2. A coupler as set forth in claim 1 in which said ledge means is joined to an upward extension on said head forming a continuation of said buffing jaw.

3. A coupler as set forth in claim 2 in which said extension has a forward face that is a continuation of and lies in the same plane as said buffing face.

4. A coupler as set forth in claim 1 in which said ledge means extends into overlapping engagement with said pulling jaw on an opposing similar coupler when the couplers are in coupled relationship.

5. A coupler as set forth in claim 1 in which said pulling jaw has a top surface which slopes upwardly from the forward end of the jaw and is adapted to engage the underside of said ledge means on an opposing similar coupler to effect vertical gathering of one coupler relative to the other when the couplers approach for coupling from a position of lateral and vertical displacement relative to each other.

6. A coupler as set forth in claim 1 in which a portion of the underside of said ledge means slopes upwardly toward the end of said ledge means in a direction away from said side face of the buffing jaw.

7. A coupler as set forth in claim 1 in which said gathering means also comprises a laterally extending wing disposed rearwardly of said buffing jaw, said wing having a front face adapted for engagement with the pulling jaw of an opposing similar coupler to bring said couplers into alignment as the couplers approach for coupling from angular positions, said wing having a projection at its lateral extremity extending forward of said front face.

8. A coupler as set forth in claim 7 in which said projection and front face form a socket for engagement with the forward end of said pulling jaw.

* * * * *